US010213790B2

(12) United States Patent
Klinkhammer

(10) Patent No.: US 10,213,790 B2
(45) Date of Patent: Feb. 26, 2019

(54) METHOD FOR PROCESSING ASH FROM WASTE INCINERATION PLANTS BY MEANS OF WET CLASSIFICATION

(71) Applicant: SCHAUENBURG MASCHINEN—UND ANLAGEN-BAU GMBH, Mülheim (DE)

(72) Inventor: Manfred Klinkhammer, Neukirchen-Vluyn (DE)

(73) Assignee: Schauenburg Maschinen—Und Anlagen-Bau GmbH, Muelheim (DE)

( * ) Notice: Subject to any disclaimer, the term of this patent is extended or adjusted under 35 U.S.C. 154(b) by 0 days.

(21) Appl. No.: 15/105,488

(22) PCT Filed: Dec. 9, 2014

(86) PCT No.: PCT/EP2014/077004

§ 371 (c)(1),
(2) Date: Jun. 16, 2016

(87) PCT Pub. No.: WO2015/096977

PCT Pub. Date: Jul. 2, 2015

(65) Prior Publication Data

US 2016/0310960 A1 Oct. 27, 2016

(30) Foreign Application Priority Data

Dec. 23, 2013 (DE) ..... 10 2013 021 790
Jan. 23, 2014 (DE) ..... 10 2014 100 725

(51) Int. Cl.
*B03B 9/04* (2006.01)
*F23J 1/00* (2006.01)

(52) U.S. Cl.
CPC ..... *B03B 9/04* (2013.01); *F23J 1/00* (2013.01); *F23J 2900/01001* (2013.01); *F23J 2900/01005* (2013.01)

(58) Field of Classification Search
CPC .... B04C 3/00; B04C 5/24; B04C 5/26; B04C 5/28; B04C 5/30; F23J 1/00; F23J 2900/01001; F23J 2900/01005
(Continued)

(56) References Cited

U.S. PATENT DOCUMENTS 2,754,968 A 7/1956 Vegter et al.
5,776,304 A * 7/1998 Vikio ..... D21B 1/32 162/4
(Continued)

FOREIGN PATENT DOCUMENTS

DE 10 2011 013030 A1 9/2012
EP 2 052 780 A2 4/2009
(Continued)

OTHER PUBLICATIONS

International Preliminary Report on Patentability of International Application No. PCT/EP2014/077004 (with English translation) dated Jun. 28, 2016, 15 pages.
(Continued)

*Primary Examiner* — Joseph C Rodriguez
*Assistant Examiner* — Kalyanavenkateshware Kumar
(74) *Attorney, Agent, or Firm* — Fay Sharpe LLP

(57) ABSTRACT

A method for processing ash from waste incineration plants by wet classification includes mixing the ash with a liquid in a mixing hopper. After screening, the mixture is fed to a first classifying stage, including an upflow classifier and an upstream hydrocyclone, where it is separated into a good fraction and a residual fraction. The residual fraction is drawn off as a suspension on an upper side of a fluidized bed of the upflow classifier. The good fraction is drawn off on an underside of the fluidized bed. A pass through fraction is fed back into the hydrocyclone installation and a material flow containing particles which are smaller than a separation particle size is separated as cyclone overflow. The cyclone overflow is separated in a second classifying stage into a fine particle mineral fraction and a residue which has a grain size upper limit between 20 μm and 50 μm.

20 Claims, 1 Drawing Sheet

(58) Field of Classification Search
USPC ..... 209/725–734
See application file for complete search history.

(56) References Cited

U.S. PATENT DOCUMENTS

| | | | | |
|---|---|---|---|---|
| 5,794,791 | A * | 8/1998 | Kindig | B03B 5/34 209/12.1 |
| 5,996,806 | A * | 12/1999 | Vikio | D21B 1/32 209/10 |
| 9,216,419 | B2 | 12/2015 | Evers et al. | |
| 2002/0017224 | A1 | 2/2002 | Horton | |
| 2014/0054202 | A1* | 2/2014 | Evers | B03B 9/04 209/10 |
| 2015/0041374 | A1* | 2/2015 | Kramer | B04C 5/26 209/729 |

FOREIGN PATENT DOCUMENTS

| | | | |
|---|---|---|---|
| GB | 777561 | A | 6/1957 |
| WO | WO 2012/119737 | A1 | 9/2012 |

OTHER PUBLICATIONS

International Search Report of International Application No. PCT/EP2014/077004 dated Mar. 24, 2015, 6 pages.

* cited by examiner

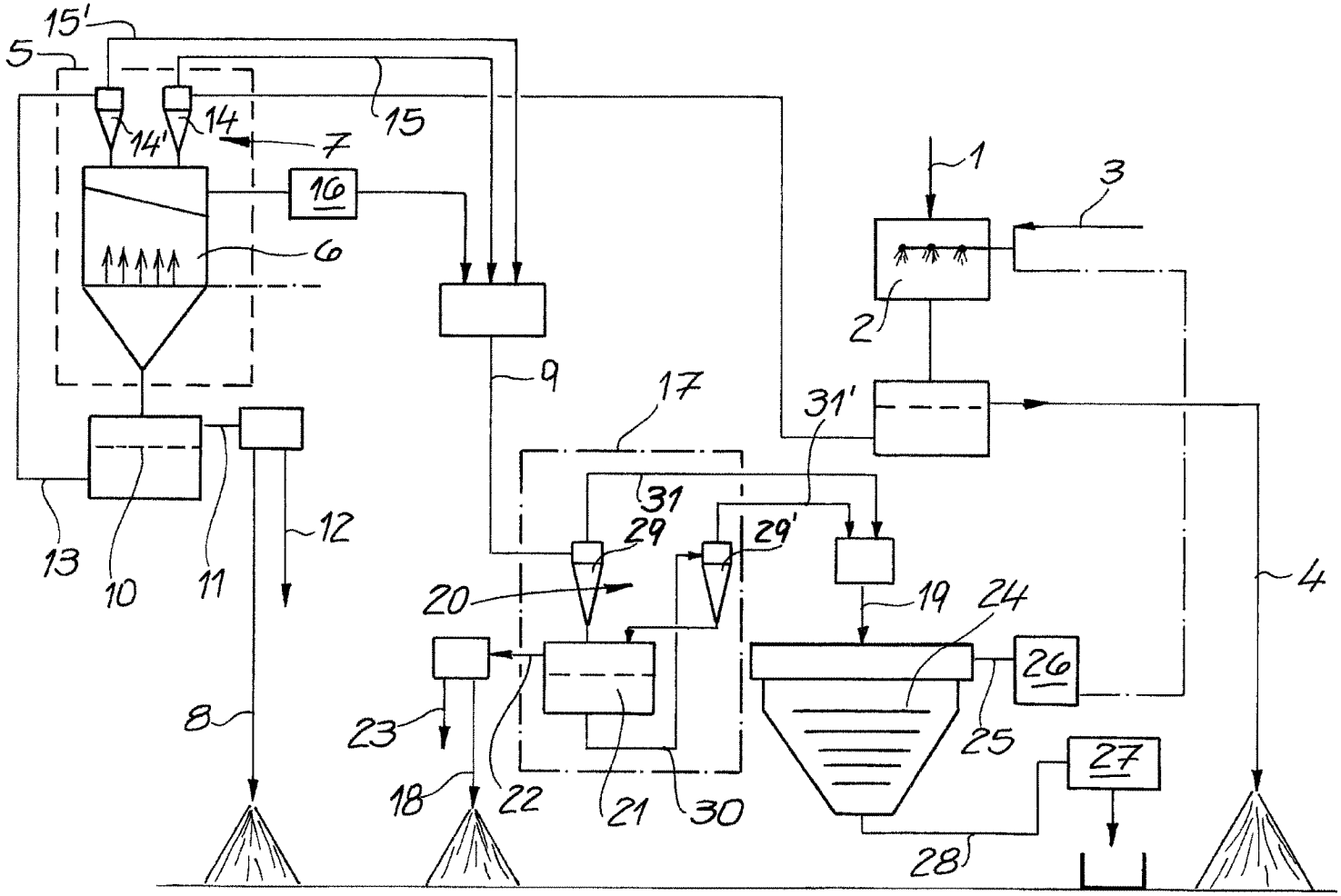
1
2
3
4
5
6
7
8
9
10
11
12
13
14
14'
15
15'
16
17
18
19
20
21
22
23
24
25
26
27
28
29
29'
30
31
31'

METHOD FOR PROCESSING ASH FROM WASTE INCINERATION PLANTS BY MEANS OF WET CLASSIFICATION

The invention relates to a method for processing ash from waste incineration plants, in particular domestic waste incineration plants, by wet classification according to the preamble of claim 1.

Classification is understood as a separation of starting material consisting of particles having a given grain size distribution into several fractions having different grain size distributions. Classification is used in particular to separate the ash into fractions contaminated to various extent with harmful substances.

Known from DE 10 2011 013 030 A1 is a method for processing ash from waste incineration plants by wet classification, in which the ash is mixed with liquid in a mixing hopper and after screening a coarse fraction is fed as feed flow to a classifying stage, which comprises an upflow classifier and an upstream hydrocyclone installation. The feed flow is separated in the classifying stage into a good fraction, free of harmful substances, and a residual fraction contaminated with harmful substances, wherein the residual fraction is drawn off as a suspension on the upper side of a fluidized bed produced in the upflow classifier and wherein the good fraction drawn off on the underside of the fluidized bed is dewatered by means of a screening device. The good fraction has a grain spectrum between 0.25 mm and 4 mm and can be dumped without environmental regulations or possibly also recycled economically, e.g. as aggregate in road construction. The residue contains particles having a grain size of less than 250 μm and contains harmful substances, e.g. heavy metals, light organic substances and metal oxides which are deposited as a coating on the particles. In addition, the residue fraction contains some valuable substances such as, for example, iron and non-ferrous metals. The residue is thickened and must be dumped while incurring costs to meet relevant statutory regulations. The dry weight fraction of the residual fraction contaminated with harmful substances is between 10% and 30% of the ash feed quantity.

Against this background, it is the object of the invention to further reduce the residual quantity which cannot be recycled economically wherein at the same time it must be ensured that the harmful substances are completely bound to the fine-particle residue.

The subject matter of the invention and solution of this object is a method according to claim 1.

The invention links to a method having the features described initially. According to the invention, the pass-through fraction of the screening device is fed back into the hydrocyclone installation. In the hydrocyclone installation at least one material flow containing substantially only particles which are smaller than the separation particle size of the screening process is separated as cyclone overflow. The separation particle size is understood as that particle size of which 50% can be found in the coarse fraction and 50% in the fine fraction. The cyclone overflow of the hydrocyclone installation is then separated in a second classifying stage into a fine-particle mineral fraction and a residue contaminated with harmful substances, wherein the residue has a grain-size upper limit between 20 μm and 50 μm.

Preferably the hydrocyclone installation comprises two hydrocyclones connected in parallel, wherein the feed flow is fed to a first hydrocyclone of the hydrocyclone installation and the pass-through fraction of the screening device is fed to the second hydrocyclone of the hydrocyclone installation.

The cyclone overflows of the hydrocyclones connected in parallel each contain only particles which are smaller than the separation grain size of the screening device and are fed to the second classifying stage.

The screening residue of the screening device expediently has a lower grain size of more than 150 μm. Preferably the screening device is operated so that the lower grain size of the screening residue is about 250 μm. The hydrocyclone installation is designed so that the cyclone overflow substantially only entrains particles having a grain size of less than 100 μm. Preferably the hydrocyclone installation is operated so that the grain-size upper limit of the suspension drawn off in the hydrocyclone overflow lies in a range between 60 and 70 μm.

The screening dewatering is preferably combined with a metal separation. The metal separation can in this case refer to both the separation of non-ferrous metals and also of ferrous components which are separated from the screening residue.

A further advantageous embodiment of the method according to the invention provides that light organic substances are separated from the residual fraction drawn off from the upflow classifier. This includes in particular also fibrous materials. For example, a tumbler screen can be used for the separation of organic contaminants. In addition, automatic backflush filters can also be used. After separation of the light organic substances, the residual fraction is fed together with the cyclone overflow of the hydrocyclone installation to the second classifying stage.

A hydrocyclone installation is expediently also used in the second classifying stage, which can comprise a plurality of hydrocyclones connected in parallel as a multicyclone. The mineral fraction is drawn off as cyclone underflow. The cyclone overflow entrains the fine-particle residue contaminated with harmful substances. This has a grain spectrum with a grain-size upper limit between 20 μm and 50 μm. Preferably the hydrocyclone installation of the second classifying stage is operated so that the residue in the cyclone overflow has a grain-size upper limit of about 25 μm.

The cyclone underflow of the hydrocyclone installation used in the second classifying stage is expediently dewatered by means of a screening device. The screening device can be combined with a metal separation which separates non-ferrous metals and/or ferrous components from the screening residue. The dewatered residue then forms a fine-particle mineral fraction without perturbing contents, which fraction can be recycled economically. In addition, fine-particle metals accumulate as valuable products which can be separated from the screening residue by means of metal separation.

The cyclone overflow of the hydrocyclone installation used in the second classifying stage is expediently concentrated in a thickener, which can be configured as a continuously operated sedimentation separator. Clarified liquid is drawn off from the thickener and returned into the process as process liquid.

The liquid return can comprise a liquid tank to which a water treatment plant is connected. At least one pH setting is made in the course of the water treatment.

A suspension having a high solid content is drawn off from the thickener. Said suspension is then dewatered, wherein preferably a pressure filtration is used for dewatering the residue. The pressure filtration can, for example, be configured as a chamber filter press or as a drum filter press.

A substantial advantage of the method according to the invention compared with the prior art from DE 10 2011 013 030 A1 is that a substantially smaller mass flow comprising fine particles which have a grain size of less than 50 μm is fed to the thickener and in consequence thereof the downstream pressure dewatering is simpler in terms of process technology and can be operated with smaller apparatus.

The invention will be explained hereinafter with reference to a drawing showing merely one exemplary embodiment. The SINGLE FIGURE shows as a highly simplified block diagram a system for the processing of ash by wet classification.

The ash 1 comes from a waste incineration plant, in particular a domestic waste incineration plant, and is mixed with liquid 3 in a mixing hopper 2 and after screening a coarse fraction 4, is fed to a classifying stage 5. The coarse fraction 4 comprises a grain spectrum between 4 mm and 60 mm and can optionally be divided into two or more coarse fractions. The screening devices used for this purpose can be fitted with metal separators to separate non-ferrous metals or iron.

The classifying stage 5 comprises an upflow classifier 6 and an upstream hydrocyclone installation 7. The feed flow is separated in the classifying stage 5 into a good fraction 8 free from harmful substances and a residual fraction 9 contaminated with harmful substances, wherein the residual fraction 9 is drawn off as a suspension on the upper side of a fluidized bed produced in the upflow classifier 6 and wherein the good fraction 8 drawn off on the underside of the fluidized bed is dewatered by means of a screening device 10. The screening residue 11 of the screening device 10 expediently has a lower grain size of more than 150 μm. Preferably the classifying stage 5 is operated so that the screening residue 11 of the screening device 10 has a grain spectrum between 250 μm and 4 mm. Metals 12 separated from the screening residue can be recycled as valuable materials. The screening residue 11 having a grain spectrum between 0.25 mm to 4 mm is free from harmful substances and can be recycled economically.

The pass-through fraction 13 of the screening device 10 is fed back to the hydrocyclone installation 7, which in the exemplary embodiment comprises two hydrocyclones 14, 14' connected in parallel. The feed flow is fed to a first hydrocyclone 14 of the hydrocyclone installation 7. The pass-through fraction 13 of the screening device 10 enters as feed into the second hydrocyclone 14' of the hydrocyclone installation 7. The cyclone overflows 15, 15' of the hydrocyclones 14, 14' connected in parallel substantially only contain particles which are smaller than the separation grain of the screening device 10. In the exemplary embodiment, the screening residue 11 of the screening device 10 has a lower grain size of more than 150 μm, preferably a lower grain size of about 250 μm. The cyclone overflows 15, 15' are designed for a separating section of about 60 to 70 μm and substantially only entrain particles having a grain size of less than 100 μm.

Light organic substances, in particular fibrous substances, are separated from the residual fraction 9 drawn off from the upflow classifier 6, wherein the separation of light substances can be accomplished, for example, by means of a tumbler screen 16. The residual fraction 9 is then fed together with the cyclone overflows 15, 15' to a second classifying stage 17, in which the material flows are separated into a fine-particle mineral fraction 18 as well as a residue 19 contaminated with harmful substances. The second classifying stage 17 is operated so that the residue 19 has a grain-size upper limit between 20 and 50 μm. Preferably a grain-size upper limit of the residue 19 is about 25 μm.

In the second classifying stage 17, a hydrocyclone installation 20 is used wherein the fine-particle mineral fraction 18 is drawn off as cyclone underflow and the cyclone overflow entrains the fine-particle residue 19 contaminated with harmful substances. The cyclone underflow is dewatered by means of a screening device 21, wherein metals 23 are expediently separated from the screening residue 22. A fine-particle mineral valuable product accumulates, which has a grain spectrum between 20 and 250 μm. In addition, metals 23 accumulate in fine-particle form, which can also be recycled as valuable substances.

The hydrocyclone installation 20 comprises two hydrocyclones 29, 29' connected in parallel, wherein the feed flow is fed to a first hydrocyclone 29 of the hydrocyclone installation 20 and the pass-through fraction 30 of the screening device 21 is fed to the second hydrocyclone 29' of the hydrocyclone installation. The cyclone overflows 31, 31' of the hydrocyclones 29, 29' connected in parallel are fed to a thickener 24.

The cyclone overflow of the hydrocyclone installation used in the second classifying stage 17 is concentrated in the thickener 24, wherein clarified liquid 25 is drawn off from the thickener 24 and fed back into the process. The liquid return comprises a liquid tank 26, to which a water treatment system is connected. A suspension 28 having a high solid content is drawn off from the thickener 24, which suspension is then dewatered by a pressure filtration 27. The fine-particle residue has a grain spectrum with a grain upper limit between 20 and 50 μm, wherein preferably a grain upper limit of about 25 μm is selected. The residue consisting exclusively of very fine particles has a large surface area to which the harmful substances contained in the ash are effectively bound. Metal oxides are also separated with the fine-particle residue.

The invention claimed is:

1. A method for processing ash from waste incineration plants by wet classification comprising:

mixing ash with liquid in a mixing hopper;

screening a coarse fraction from the ash;

feeding the ash as a feed flow to a first classifying stage which comprises an upflow classifier and an upstream hydrocyclone installation;

separating the feed flow in the first classifying stage into a good fraction free of harmful substances and a residual fraction contaminated with harmful substances;

drawing off the residual fraction as a suspension on an upper side of a fluidized bed contained in the upflow classifier;

drawing off the good fraction on an underside of the fluidized bed;

dewatering the good fraction by means of a screening device;

feeding a pass-through fraction of the dewatered good fraction in the screening device back into the upstream hydrocyclone installation;

separating, in the upstream hydrocyclone installation, at least one material flow containing substantially only particles which are smaller than a separation particle size of the screening process as a cyclone overflow; and separating the cyclone overflow in a second classifying stage into a fine particle mineral fraction with a grain spectrum between 20 μm and 250 μm and a fine particle residue contaminated with harmful substances, wherein the fine particle residue has a grain size upper limit between 20 μm and 50 μm.

2. The method as claimed in claim 1, wherein the hydrocyclone installation comprises two hydrocyclones connected in parallel, wherein the feed flow is fed to a first hydrocyclone of the hydrocyclone installation and the pass-through fraction of the screening device is fed to the second hydrocyclone of the hydrocyclone installation and wherein the cyclone overflows of the hydrocyclones connected in parallel are fed to the second classifying stage and substantially only contain particles which are smaller than the separation grain size of the screening carried out in the screening device.

3. The method as claimed in claim 1, wherein a screening residue of the screening device has a lower grain size of more than 150 μm and wherein the cyclone overflow of the hydrocyclone installation substantially only entrains particles having a grain size of less than 100 μm.

4. The method of claim 3 wherein the lower grain size is about 250 μm.

5. The method as claimed in claim 1, wherein metals are separated from the screening residue.

6. The method as claimed in claim 1, wherein light organic substances are separated from the residual fraction drawn off from the upflow classifier and wherein the residual fraction is then fed together with the cyclone overflow to the second classifying stage.

7. The method as claimed in claim 1, wherein a hydrocyclone installation is used in the second classifying stage, wherein the mineral fraction is drawn off as cyclone underflow and the cyclone overflow entrains the fine-particle residue contaminated with harmful substances.

8. The method as claimed in claim 7, wherein the cyclone underflow is dewatered by means of a screening device.

9. The method as claimed in claim 8, wherein metals are separated from a screening residue of the screening device used in the second classifying stage.

10. The method as claimed in claim 7, wherein the cyclone overflow of the hydrocyclone installation used in the second classifying stage is concentrated in a thickener, wherein clarified liquid is drawn off from the thickener and returned into the process.

11. The method as claimed in claim 10, wherein a liquid return comprises a liquid tank to which a water treatment plant is connected.

12. The method as claimed in claim 10, wherein a suspension having a high solid content is drawn off from the thickener and then dewatered.

13. The method as claimed in claim 12, wherein a pressure filtration is used for dewatering the residue.

14. The method of claim 1 further comprising separating, in the second classifying stage, metals in fine particle form.

15. The method of claim 14 further comprising recycling the fine particle metals.

16. The method of claim 1 further comprising separating, in the second classifying stage, metal oxides together with the fine particle residue.

17. A method for processing ash from waste incineration plants by wet classification comprising:

mixing ash with liquid in a mixing hopper;

feeding the ash as a feed flow to a first classifying stage which comprises an upflow classifier and a first hydrocyclone installation;

separating the feed flow in the first classifying stage into a good fraction free of harmful substances and a residual fraction contaminated with harmful substances;

drawing off the residual fraction as a suspension on an upper side of a fluidized bed contained in the upflow classifier;

drawing off the good fraction on an underside of the fluidized bed;

feeding a pass-through fraction of the good fraction flowing through a screening device back into the first hydrocyclone installation;

separating, in the first hydrocyclone installation, at least one material flow containing substantially only particles which are smaller than a separation particle size of the screening device as a cyclone overflow; and separating the cyclone overflow in a second classifying stage, which comprises a second hydrocyclone installation, into a fine particle mineral fraction with a grain spectrum between 20 μm and 250 μm and a fine particle residue contaminated with harmful substances, wherein the fine particle residue has a grain size upper limit between 20 μm and 50 μm.

18. The method of claim 17, wherein the first hydrocyclone installation comprises two hydrocyclones connected in parallel, wherein the feed flow is fed to a first hydrocyclone of the first hydrocyclone installation and the pass-through fraction of the screening device is fed to the second hydrocyclone of the first hydrocyclone installation and wherein the cyclone overflows of the two hydrocyclones are fed to the second classifying stage and substantially only contain particles which are smaller than the separation grain size of the screening carried out in the screening device.

19. The method of claim 17, wherein in the second hydrocyclone installation, the fine particle mineral fraction is drawn off as a cyclone underflow and a cyclone overflow entrains the fine-particle residue contaminated with harmful substances.

20. The method of claim 17 further comprising:

separating, in the second classifying stage, metals in fine particle form; and recycling the fine particle metals.

* * * * *